United States Patent [19]

Kuo

[11] Patent Number: 4,506,268

[45] Date of Patent: Mar. 19, 1985

[54] LOG-PERIODIC ANTENNA

[75] Inventor: Samuel C. Kuo, Saratoga, Calif.

[73] Assignee: GTE Products Corporation, Stamford, Conn.

[21] Appl. No.: 538,353

[22] Filed: Oct. 3, 1983

Related U.S. Application Data

[63] Continuation of Ser. No. 309,874, Oct. 9, 1981, abandoned.

[51] Int. Cl.[3] ..... H01Q 11/10

[52] U.S. Cl. ..... 343/792.5

[58] Field of Search ..... 343/792.5, 814, 820

[56] References Cited

U.S. PATENT DOCUMENTS

| | | | |
|---|---|---|---|
| 3,134,979 | 5/1964 | Bell | 343/792.5 |
| 3,366,964 | 1/1968 | Ramsay et al. | 343/792.5 |
| 3,641,579 | 2/1972 | Voronoff | 343/792.5 |
| 3,732,572 | 5/1973 | Kuo | 343/792.5 |
| 4,360,816 | 11/1982 | Corzine | 343/792.5 |

*Primary Examiner*—Eli Lieberman

*Attorney, Agent, or Firm*—John F. Lawler; Russell A. Cannon

[57] ABSTRACT

A log-periodic antenna comprises two arrays of dimensionally tapered radiating elements disposed in the E-plane and each fed by a balanced line consisting of the inner conductors of two coaxial cables. In one embodiment the elements of each array are dipoles and in another embodiment are formed of continuous conductive strips in zig-zag patterns on non-conductive support members. Each array preferably have two sets of elements disposed in planes, respectively, which converge toward the smaller end of the array with vertically aligned radiating elements of each set projecting in opposite directions from the array axis. Periodic gain dropout anomalies across the antenna operating band are eliminated by use of a shielded feed line.

13 Claims, 9 Drawing Figures

LOG-PERIODIC ANTENNA

RELATED APPLICATION

This is a continuation of application Ser. No. 309,874, filed Oct. 9, 1981, now abandoned.

BACKGROUND OF THE INVENTION

This invention relates to frequency independent antennas and more particularly to frequency independent log-periodic antenna arrays.

Log-periodic antennas, well known for their psuedo-frequency independent operation, are arrayed together to provide higher directivity and higher gain and also to adapt the antennas for use in direction finding and tracking applications. Such uses of arrayed log-periodic antennas provide independent error curves for either amplitude comparison or for sum and difference derivations. A problem with such arrays is the periodic occurrence of gain variations in the E-plane (horizontal) arrays of the antenna across the operating band. These periodic gain variations or "dropouts" are accompanied by pattern deteriorations and seriously adversely affect the performance of the antenna. When a conventional log-periodic dipole antenna was arrayed in the frequency independent manner in the E-plane, periodic gain dropouts of more than 10 dB over an active operating band were measured in spite of the fact that the individual antenna elements of the array provide frequency independent operation.

Attempts to decrease or eliminate such gain dropouts and pattern deteriorations have been attempted in the past. By using size-reduced dipoles as radiating elements as described in U.S. Pat. No. 3,732,572, the magnitude of the gain dropouts has been reduced but not completely eliminated. Another technique that has been proposed in wrapping of the two-wire transmission line with RF absorbing material, see "A Study of TEM Resonances on a Class of Parallel Dipole Arrays" by Tranquilla et al, Proceedings of the 1977 Antenna Applications Symposium, Electromagnetics Laboratory, University of Illinois, Urbana Champaign, Ill. Apr. 27–29, 1977. Such absorbing materials, however, produce substantial losses of approximately 4 to 6 dB at all frequencies and therefore is not an acceptable solution to the problem.

This invention is directed to a frequency independent antenna that overcomes this gain dropout anomaly.

OBJECTS AND SUMMARY OF THE INVENTION

A general object of the invention is the provision of a log-periodic antenna having arrays of elements in the E-plane operating over the frequency band of the antenna without gain dropouts.

A further object is the provision of such an antenna in which periodic gain dropouts are eliminated without otherwise detracting from the performance characteristics of the antenna.

These and other objects of the invention are achieved by utilizing a shielded balanced feed line for energizing log-periodic antenna elements arrayed in a frequency independent manner in the E-plane. A preferred form of the shielded feed line is the inner conductor of a coaxial cable.

DESCRIPTION OF PREFERRED EMBODIMENTS

Figure 1:
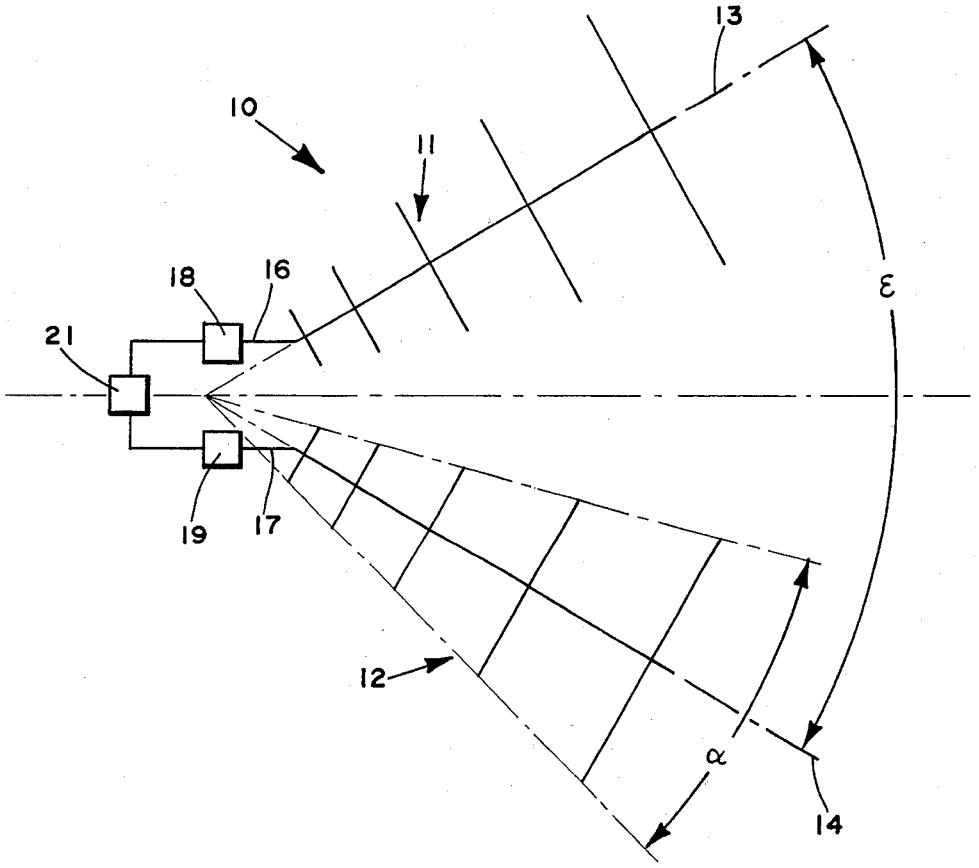
FIG. 1 is a schematic plan view of a log-periodic dipole antenna embodying this invention.

Referring now to the drawings, FIG. 1 illustrates an antenna 10 embodying the invention and comprising dipole arrays 11 and 12 in a horizontal (E) plane, the axes 13 and 14 of arrays 11 and 12, respectively, forming an angle $\epsilon$. Arrays 11 and 12 have feed lines 16 and 17, respectively, connected to hybrid T junctions 18 and 19, respectively, also known as magic T junctions. The outputs of the magic T junctions 18 and 19 are connected to a power divider 21 which in turn is connected to utility apparatus such as a receiver or transmitter.

Figure 2:
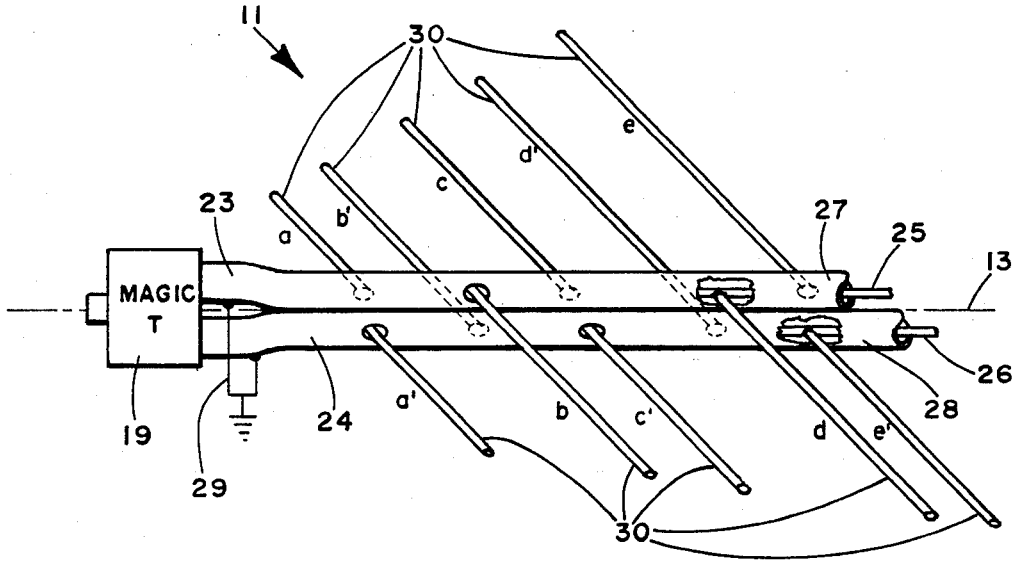
FIG. 2 is a perspective view of one of the arrays of FIG. 1 with parts of the feed lines broken away to show details of construction.

Antenna arrays 11 and 12 are substantially identical in construction and accordingly only one of them, array 11, is shown in FIG. 2 and is described. Feed lines 16 of array 11 comprises vertically stacked coaxial cables 23 and 24 having inner conductors 25 and 26, respectively, and outer conductors 27 and 28, respectively. The outer conductors are grounded as indicated at 29 and thus shield the inner conductors. Cables 23 and 24 are connected to magic T 18 which provides 180° phase reversal in the two lines as required for end fire radiation along array axis 13.

Radiating elements 30 are connected to the feed lines transversely of the array axis 13 such that element dimensions and interelement spacings decrease from a maximum at one end to a minimum at the other in increments of a predetermined ratio $\tau$. These elements comprise a first set a, b, c, d and e connected to inner conductor 25 of cable 23 and a second set a′, b′, c′, d′ and e′ connected to inner conductor 26 of cable 24. Each element extends through an opening in the outer conductor of the associated cable for direct electrical contact with the inner conductor thereof. The elements of each array are arranged in transversely extending pairs, each pair being designated by the same letter a–a′, b–b′, etc., and each pair comprising one dipole. Inner conductors 25 and 26 are the balanced feed lines for the array and by connecting them to the radiating elements and by grounding outer conductors 27 and 28 as described, the feed lines are shielded from external radiation including the effects of mutual coupling between arrays 11 and 12. By use of these shielded feed lines, periodic gain variations across the operating band of the antenna are eliminated A log-periodic dipole antenna 10 constructed as described above had the following design parameters and performance characteristics:

| | |
|---|---|
| Convergence angle $\epsilon$ | 26 |
| Taper angle $\alpha$ | 20° |
| $\tau$ | 0.9 |
| Smallest dipole | 5" |
| Largest dipole | 16" |
| Feed line impedance ($Z_0$) | 100 ohms |
| Frequency band | 470–900 MHz |

The feeder impedance is 100 ohms because 50 ohm coaxial cables were used. This antenna provides pseudo-frequency independent performance similar to a log-periodic dipole antenna fed by conventional balanced lines. When two dipole arrays are arrayed in the frequency indpendent manner at relatively close spacing, i.e., 0.5 wavelength the antenna provided substantially frequency independent performance with no periodic gain dropouts or pattern deteriorations. The dipole antenna described above is constructed to operate at UHF frequencies readily but not at microwave frequencies due to the physical size of the balun and the manner in which the radiators are attached to the transmission lines.

The shielded feed lines described above as the inner conductors of coaxial cables achieve the objects of the invention efficiently and economically since standard commercially available cable is utilized. Practice of the invention, however, is not limited to this feed line which alternatively may take the form of twin spaced conductors within a single enclosing grounded shield having openings through which the dipoles extend for connection to the lines as described above.

Figure 3:
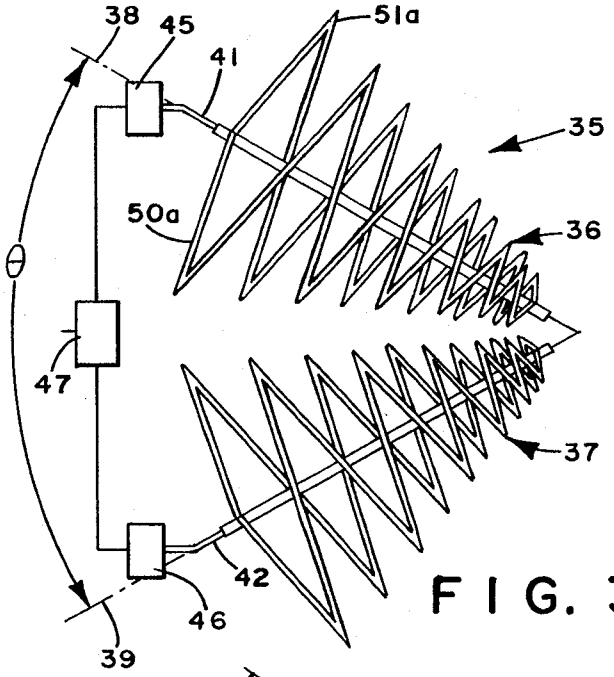
FIG. 3 is a schematic plan view similar to FIG. 1 showing arrays having a zig-zag pattern of radiating elements.
Figure 4:
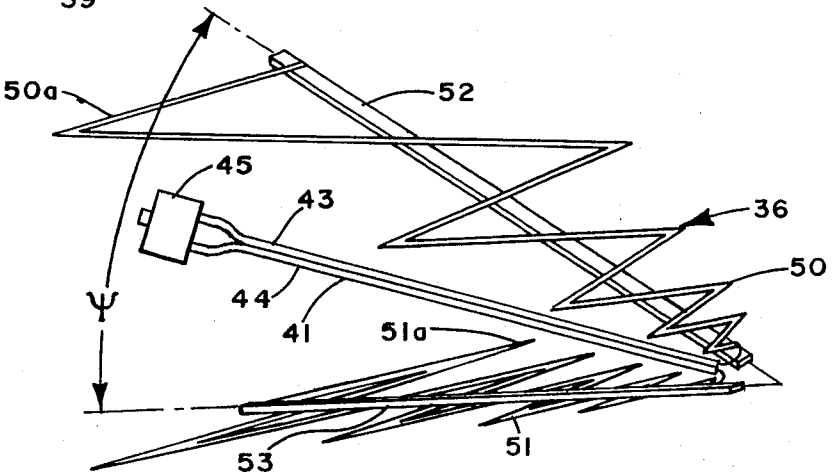
FIG. 4 is an enlarged perspective view of one of the arrays of FIG. 3.

Periodic gain dropouts and pattern deteriorations are not limited to E-plane arrays of the planar log-periodic dipole antennas of the type described above. Open structure types of log-periodic antennas comprising E-plane arrays with the radiating elements of each array in two planes converging to the feed point also have periodic gain dropouts when arrayed in the frequency independent manner. An example of such open type structure is illustrated in FIGS. 3 and 4 and comprises antenna 35 having substantially identical arrays 36 and 37, each array having two sets of radiating elements converging at an angle $\psi$ in the H-plane (vertical). The angle $\psi$ determines the H-plane beamwidth and the mean level of the input impedance of the antenna and distinguishes the "open" structure from the planar antenna. In other words, when the angle $\psi$ approaches 0, a planar antenna comparable to the above described log-periodic dipole antenna results.

Figure 5:
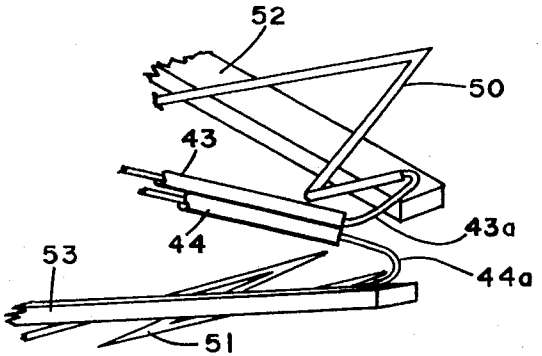
FIG. 5 is a greatly enlarged portion of FIG. 4 showing the connection of the feed lines to the radiating elements.

Arrays 36 and 37 have axes 38 and 39 respectively, which converge at an angle $\theta$ toward the feed points of the arrays, and in accordance with this invention, are fed by balanced lines 41 and 42, respectively. These arrays are substantially identical and accordingly only one of them, array 36, is described. Feed line 41 comprises the inner conductors 43*a* and 44*a* of coaxial cables 43 and 44, respectively, see FIGS. 4 and 5. Cables of lines 41 and 42 are connected to magic T couplers 45 and 46, respectively, which in turn are connected to a power divider 47 for connection to associated utility apparatus. Array 36 comprises a pair of conductive strips 50 and 51 in tapered zig-zag shapes forming triangularly shaped radiating elements. Strips 50 and 51 are mounted on elongated support members 52 and 53, respectively, composed of dielectric material such as epoxy fiberglass. The outer conductors of coaxial cables 43 and 44 are suitably grounded and the inner conductors 43*a* and 44*a* thereof are connected to strips 50 and 51, respectively, at the converging end of the array to constitute the feed point.

The triangular portions of strips 50 and 51 having the same spacing from the array feed point project equal distances and in opposite directions from supports 52 and 53, respectively, and constitute the radiating elements of the array. For example, segment 50*a* of strip 50 and segment 51*a* of strip 51 are equally spaced from the feed point and project equal distances and in opposite directions from supports 52 and 53, respectively. Segments 50*a* and 51*a* thus have equal lengths and constitute one radiating element of the array analogous to a dipole of array 11.

Figure 6:
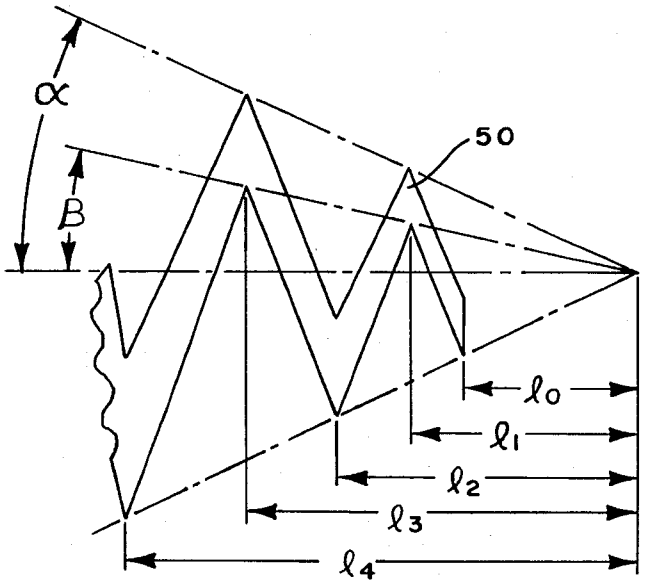
FIG. 6 is a greatly enlarged plan view of a portion of the zig-zag shaped conductive strip of FIGS. 3–5 showing design parameters.

The continuous zig-zag shaped conductive strip is defined by two conventional log-periodic design parameters $\alpha$ see FIG. 6, and $\tau$. An additional design parameter $\beta$ defines the width of the zig-zag conductor. When the value of $\beta$ approaches the value of $\alpha$, the antenna structure approaches that of a zig-zag wire. As the value of $\beta$ decreases, the width of the zig-zag conductor increases until $\beta$ approaches 0. The array structure consisting of two of these zig-zag conductors performs similarly to the conventional log-periodic dipole array with the exception of a slight loss of gain due to the $I^2R$ loss. The exciting currents, instead of travelling straight on the metallic boom of the conventional antenna, follow the zig-zag conductor path before reaching the active region of the array. The loss is less than 1 dB. By decreasing the angle $\beta$ this loss is minimized with the tradeoff of a slight increase in the amount of conductive material. The spacings $l_0, l_1, l_2, \ldots l_n$ of the elements from the point of convergence as illustrated in FIG. 6 are related to each other log-periodically in accordance with the following formulae:

$$l_3=\sqrt{\tau l_4}$$

$$l_2=\sqrt{\tau l_3}$$

$$l_n=\sqrt{\tau l_n}$$

A circularly polarized antenna embodying the invention was constructed by substituting a 90° coupler for the power divider 47 in FIG. 3 and such antenna had the following parameters:

| | |
|---|---|
| $\alpha$ | 20° |
| $\beta$ | 7° |
| $\sqrt{\tau}$ | 0.9 |
| Length of smallest element | 0.3" |
| Length of largest element | 7.0" |
| Frequency band | 1 to 12 GHz |

No periodic gain dropout anomalies were observed during operation of the above antenna.

Figure 7:
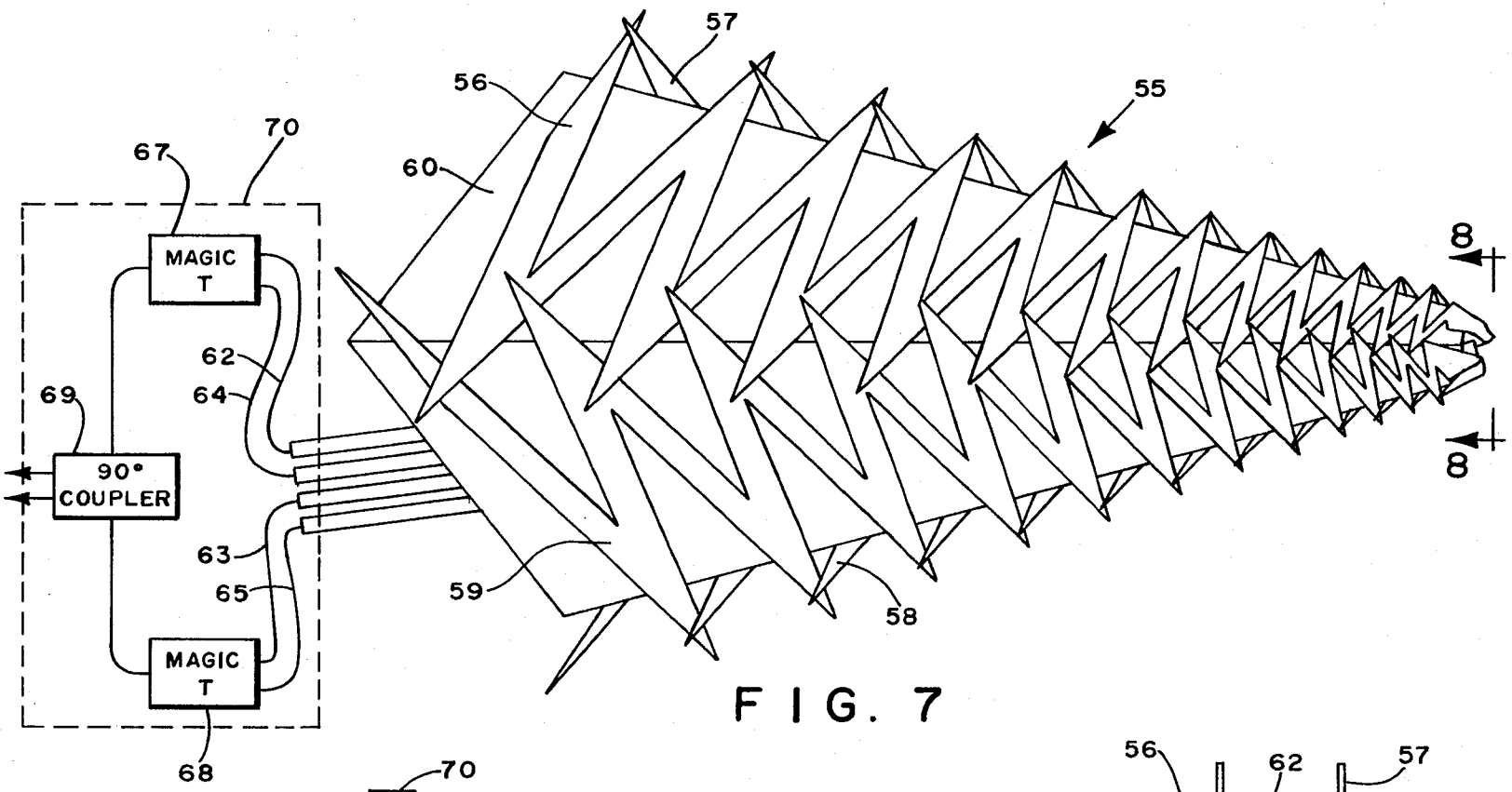
FIG. 7 is a perspective view of an array of a log-periodic antenna designed for circularly polarized operation and embodying the invention.
Figure 8:
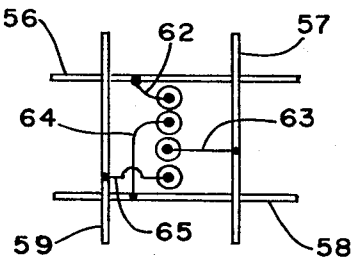
FIG. 8 is an enlarged end view of the array taken on line 8—8 of FIG. 7.
Figure 9:
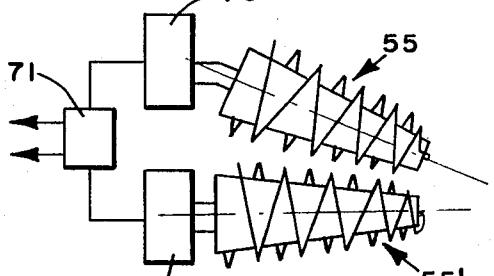
FIG. 9 is a schematic representation of two of the arrays of FIG. 7 disposed to provide direction finding information.

Another embodiment of the invention is shown in FIGS. 7, 8 and 9 depicting a circularly polarized antenna array 55 comprising four zig-zag conductive strips 56, 57, 58 and 59, similar to the strips shown in FIG. 6 and mounted on the plane sides of a pyramid-like dielectric support 60. Adjacent sides of support 60 are at right angles to each other and taper from a maximum dimension at one end to a minimum dimension at the other. Each of the strips is similarly tapered to the feed point of each at the end having the minimum dimension. The planes of adjacent strips are likewise perpendicular to each other as shown in FIGS. 7 and 8.

The array 55 is fed by the inner conductors 62, 63 and 64 and 65 of coaxial cables, the outer conductors of which are connected to ground. Cables having conductors 62 and 64 are connected to magic T 67 and cables having conductors 63 and 65 are connected to magic T 68. Each magic T is connected to a 90° coupler 69 which in turn is connected to associated utility apparatus. The magic T junctions 67 and 68 and the 90° coupler 69 are enclosed in a broken line block 70 for convenience of explanation of FIG. 9. When two such circularly polarized arrays 55 and 55' are arrayed together as shown in FIG. 9, the outputs of block 70 and identical block 70' may be combined in magic T 71 to provide direction finding data. Since two pairs of zig-zag strips are in the E-plane when the structures are arrayed as shown in FIG. 9, the antenna is subject to the gain dropout anomaly when energized by conventional unshielded feed lines. In accordance with this invention, the use of shielded feed lines for each of the array structures shown in FIG. 9 eliminates this gain dropout anomaly.

An antenna shown in FIGS. 7, 8 and 9 was constructed and operated from 0.25 to 4.0 GHz. The smallest and largest radiating elements were 0.8 inches and 26 inches, respectively. This frequency independent array was used as a direction finding antenna and operated over the above band without any periodic gain dropout anomaly.

What is claimed is:

1. A log-periodic antenna comprising a pair of arrays of radiating elements arranged in a frequency independent manner in E-planes for having substantially reduced gain dropout, each array having an axis and comprising:

first and second sets of said elements, the elements of each of said sets being axially spaced apart and having dimensions and interelement spacings which decrease from a maximum at one end to a minimum at the other end in increments at a predetermined ratio, and balanced feed means for energizing said elements, said feed means comprising first and second coaxial cables, each of said cables having an inner conductor and an outer conductor that is electrically connected to a ground reference potential, said first set of elements being electrically connected to the inner conductor of said first cable, said second set of elements being electrically connected to the inner conductor of said second cable, and axially successive elements of each of said sets projecting in opposite directions from the axis, the first sets of elements of said arrays being substantially coplanar, the second sets of elements of said arrays being substantially coplanar.

2. A log-periodic antenna having substantially reduced gain dropout comprising first and second adjacent arrays of radiating elements arranged in a frequency independent manner and in E-planes, said arrays having first coplanar sets of elements and second coplanar sets of elements, each of said sets of elements having an axis, the elements of each set having lengths and interelement spacings decreasing axially from a maximum at one end to a minimum at the other end in increments of a predetermined ratio, adjacent elements of each set extending on opposite sides of the axis of the set, and first and second feed means for energizing elements of said first and second arrays, respectively, each of said feed means comprising first and second balanced lines and means to shield said lines, said shield means being electrically connected to a ground reference potential, the elements of one of said sets of one array being connected to said first line of said first feed means and the elements of the other of said sets of said one array being connected to said second line of said first feed means, the elements of one of said sets of the other array being connected to said first line of said second feed means and the elements of the other of said sets of said other array being connected to said second line of said second feed means, each element of a first set having a length substantially equal to the length of a corresponding element of the associated second set and being axially spaced from said other end by substantially the same distance as said corresponding element, elements of substantially equal length of associated first and second sets extending in opposite directions.

3. The antenna according to claim 2 in which each of said feed means comprises a pair of coaxial cables, said lines being the inner conductors of said cables, said shield means comprising the outer conductors of said cables.

4. The antenna according to claim 2 in which the planes of said first and second sets of each array form an acute angle with each other.

5. The antenna according to claim 2 in which pairs of elements of associated sets form dipoles.

6. A log-periodic end fire antenna having an axis and substantially reduced gain dropout comprising first and second arrays of radiating elements arranged in frequency independent manners in E-plane, certain elements of the first array lying in a common plane with certain elements of a second array, each array having first and second sets of elements, the elements of each set having dimensions and interelement spacings decreasing axially from a maximum at one end to a minimum at the other in increments of a predetermined ratio, adjacent elements of each set extending on opposite sides of said axis, and having first and second shielded feed lines, the elements of said first set being electrically connected to said first line and the elements of said second set being electrically connected to the second line, the first and second sets of elements being relatively positioned to form a plurality of pairs of elements, each pair comprising an element of the first set and an element of the second set extending substantially equal distances in opposite directions transverse to said array axis.

7. The antenna according to claim 6 wherein said shields on said lines are connected to a ground reference potential.

8. The antenna according to claim 7 wherein said first and second lines comprise the inner conductors of a pair of coaxial cables and said shields thereof comprise the outer conductors of said coaxial cables.

9. A log-periodic dipole antenna having substantially reduced gain dropout and comprising a pair of arrays of radiating elements arranged in a frequency independent manner and in E-planes, each array having an axis and comprising:

first and second sets of said elements, the elements of each set being axially spaced apart and having dimensions and interelement spacings which decrease from a maximum at one end to a minimum at the other end in increments at a predetermined ratio, and balanced feed means for energizing said elements, said feed means comprising first and second lines and means to shield said lines, said first and second sets of elements being electrically connected to said first and second lines, respectively, axially successive elements of each of said sets projecting in opposite directions from the axis, with associated elements of said first and second sets forming dipoles, the first sets of elements of said arrays being substantially coplanar, and the second sets of elements of said arrays being substantially coplanar.

10. The antenna according to claim 9 wherein said shield means are connected to a ground reference potential.

11. The antenna according to claim 10 wherein said first and second lines comprise the inner conductors of a pair of coaxial cables and said shield means comprise the outer conductors of said coaxial cables.

12. The antenna according to claim 11 wherein one end of each radiating element is electrically connected to the associated inner conductor along the length thereof.

13. The antenna according to claim 12 wherein the planes of said first and second sets of each array form an acute angle with each other.

* * * * *